US005403500A

United States Patent [19]

Turner

[11] Patent Number: 5,403,500

[45] Date of Patent: Apr. 4, 1995

[54] RINSE CONDITIONER

[75] Inventor: Graham A. Turner, Bromborough, United Kingdom

[73] Assignee: Lever Brothers Company, New York, N.Y.

[21] Appl. No.: 53,588

[22] Filed: Apr. 27, 1993

[30] Foreign Application Priority Data

Apr. 28, 1992 [GB] United Kingdom ..... 9209170

[51] Int. Cl.[6] ..... D06M 13/46

[52] U.S. Cl. ..... 252/8.8; 252/8.6; 252/8.7; 252/8.8

[58] Field of Search ..... 252/8.6, 8.9

[56] References Cited

U.S. PATENT DOCUMENTS

| | | | |
|---|---|---|---|
| 4,137,180 | 1/1979 | Naik et al. | 252/8.8 |
| 4,427,558 | 1/1984 | David | 252/8.8 |
| 4,589,989 | 5/1986 | Muller et al. | 252/8.75 |
| 4,767,547 | 8/1988 | Straathof et al. | 252/8.8 |
| 4,769,159 | 9/1988 | Copeland | 252/8.8 |
| 4,970,008 | 11/1990 | Kandathil | 252/88 |
| 5,002,681 | 3/1991 | Wierenga et al. | 252/90 |
| 5,089,148 | 2/1992 | Van Blarcom et al. | 252/8.6 |
| 5,093,014 | 3/1992 | Neillie | 252/8.8 |
| 5,130,035 | 7/1992 | Dell'Armo et al. | 252/8.6 |
| 5,183,580 | 2/1993 | Lew et al. | 252/8.6 |
| 5,185,088 | 2/1993 | Hartman et al. | 252/8.6 |
| 5,200,097 | 4/1993 | Hughes et al. | 252/8.75 |
| 5,221,794 | 6/1993 | Ackerman et al. | 548/349.1 |
| 5,223,628 | 6/1993 | Whittlinger | 548/349.1 |
| 5,259,964 | 11/1993 | Chavez et al. | 252/8.6 |
| 5,284,650 | 2/1994 | Whittlinger | 424/70 |

FOREIGN PATENT DOCUMENTS

| | | |
|---|---|---|
| 041821 | 12/1981 | European Pat. Off. . |
| 065387 | 11/1982 | European Pat. Off. . |
| 234082 | 9/1987 | European Pat. Off. . |
| 409504 | 1/1991 | European Pat. Off. . |
| 486113 | 11/1991 | European Pat. Off. . |
| 504478 | 10/1992 | European Pat. Off. . |
| 2356627 | 7/1977 | France . |
| 2182972 | 7/1990 | Japan . |
| 92/08837 | 5/1992 | WIPO . |
| 92/18593 | 10/1992 | WIPO . |

OTHER PUBLICATIONS

European Search Report.

*Primary Examiner*—Paul Lieberman
*Assistant Examiner*—Michael P. Tierney
*Attorney, Agent, or Firm*—A. Kate Huffman

[57] ABSTRACT

A powder progenitive of a rinse conditioner which is used to form an aqueous dispersion of a rinse conditioner. The conditioning dispersion is formed outside the washing machine shortly before it is to be added to the washing machine. It is preferred if the rinse conditioner contains a cationic active.

8 Claims, No Drawings

RINSE CONDITIONER

This invention relates to Rinse Conditioners comprising a softening or anti-static component delivered to the wash from suspension in the wash liquor during a rinsing step.

In the past fabric conditioning has been carried out either during then rinsing step of a fabric washing and rinsing process or during tumble drying of the fabric. In almost all cases rinse conditioning is accomplished by adding a liquid dispersion of a rinse conditioning agent to the rinse water. The liquid dispersion was traditionally distributed and made available to consumers as a ready to use aqueous dispersion. More recently, concern for the environment and consumer convenience has led to the sale of concentrated aqueous dispersions which are either used in smaller amounts or are mixed with water to form a predilute before use.

In EP 234082 it has been proposed to supply rinse conditioner as a solid block. This approach requires the use of a special restraint for the block and may also require the modification of the washing machine to enable the block to be dissolved and dispensed by a spray system.

Various proposals have been made to supply fabric softener in granular or powdered form. EP 111074 is typical and uses a silica to carry the softener. A disadvantage of using a carrier such as silica is that it bulks up the product and serves no function beyond making the powder compatible with other ingredients that may be contained in a washing powder.

WO 92/18593 describes a granular fabric softening composition comprising a nonionic fabric softener and a single long alkyl chain cationic material. The specification teaches that effective cationic softening compounds when used in granular form exhibit poor dispersion properties.

It has been suggested to add rinse conditioner in powdered form directly to the washing machine. If this is done via the normal dispensing compartment there is a considerable risk that the rinse conditioner will thicken or gel after contact with residual water from a previous wash. This would prevent or hinder dispensing of the proper dose of conditioner. A way round this problem is to add the powder directly to the wash at the appropriate time. This is extremely inconvenient and may entail stopping the washing machine at the end of the main wash cycle, opening it and trying to sprinkle powder over the washing before continuing with the rinse stage.

For these reasons, despite the obvious environmental and transport saving advantages of selling a water free powdered rinse conditioner, manufacturers have not done so.

According to the present invention there is provided the use of a powder progenitive of a rinse conditioner to form an aqueous dispersion of the powder characterised in that the dispersion is formed outside the washing machine shortly before it is to be added to the washing machine.

The invention also comprises supply of a powder, progenitive of a rinse conditioner for use in a washing machine together with supply of instructions to disperse it in water outside the washing machine immediately before it is used.

The invention further comprises a method of delivering a rinse conditioner or fabric softener to a rinse liquor of a washing machine, comprising the steps of dispersing a powder containing the conditioner or softener by mixing the powder with domestic tap water to form a liquid dispersion of the powder outside the washing machine, then adding a dosed amount of the dispersion so formed to the rinse liquor of the washing machine in a conventional manner. For many mechanical machines this will involve adding the dispersion to the rinse conditioner dispensing compartment.

In the context of this invention forming the dispersion shortly before it is used means forming the dispersion for use in a particular washing procedure during the time taken to complete that washing procedure.

In the context of this invention a washing machine can be defined as a machine which works by a mechanical mechanism or a more simple device such as a bucket or bowl.

The powder may also contain a co-active. Preferably at levels of up to 20%. The coactive is preferably a fatty acid. The fatty acid coactive preferably comprises hardened tallow fatty acid.

The level of fatty acid should be kept as low as possible, preferably less than 15%, to minimise the reduction of softening performance in the case that there is carry-over of anionic active from the earlier washing part of the fabric washing and rinsing process.

Advantageously the powder contains a nonionic dispersion aid, such dispersion aids have also been shown to add an additional softening benefit. Examples of nonionic dispersion aids include long chain alcohol ethoxylates, sugars and sugar alcohols.

The powder of this invention is preferably used with water to make a fabric conditioning dispersion by the consumer in the home. It is thus advantagous if the powder is dispersed by manual shaking. Preferably the powder is shaken with water for 5 seconds, more preferably the powder is shaken with water for 2 seconds, most preferably the powder is dispersed by merely once inverting a sealed container comprising powder and water.

It is preferred if the dispersion is made using water at ambient temperature as this is more convenient for the consumer.

The composition may also contain a flow aid and other ingredients commonly found in rinse conditioners such as perfume, antifoam, preservative and dye.

Advantageously the powder contains a cationic active. Preferably the cationic active comprises more than 40% and less than 95% by weight of the powder.

The cationic may be a biodegradable quaternary ammonium compound or an imidazolium salt.

Advantageously the powder comprises a water insoluble cationic which is a compound having two $C_{12-28}$ alkyl or alkenyl groups connected to the N atom via one or more ester links.

A preferred type of ester-linked quaternary ammonium material for use in the compositions according to the invention can be represented by the formula:

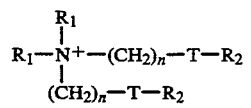

wherein each $R_1$ group is independently selected from $C_{1-4}$ alkyl, hydroxyalkyl or $C_2$–$C_4$ alkenyl groups; and wherein each $R_2$ group is independently selected from $C_{7-27}$ alkyl or alkenyl groups;

$$-\overset{\overset{\displaystyle O}{\|}}{C}-O- \quad \text{or} \quad -\overset{\overset{\displaystyle O}{\|}}{C}-O-;$$

and n is an integer from 0–5.

A second preferred type of quaternary ammonium material can be represented by the formula:

$$(R_1)_3N^+-(CH_2)_n-\underset{\underset{\displaystyle CH_2OOCR_2}{|}}{\overset{\overset{\displaystyle OOCR_2}{|}}{CH}}$$

wherein $R_1$, n and $R_2$ are as defined above.

Preferred materials of this class and their method of preparation are, for example, described in U.S. Pat. No. 4,137,180 (Lever Brothers). Preferably these materials comprise small amounts of the corresponding monoester as described in U.S. Pat. No. 4,137,180 for example 1-tallowoyloxy, 2-hydroxytrimethyl ammonium propane chloride.

Preferably the level of cationic active:fatty acid is greater than 6:1. More preferably the ratio of cationic:-fatty acid is 12:1.

The invention will now be described with reference to the following non-limiting examples:

Example 1

A powder having the composition as in Table 1 was prepared in three different ways first by dry mixing, secondly by a melt process, and finally by prilling:

TABLE 1

| COMPONENT | WEIGHT % IN PRODUCT | SUPPLIER | CHEMICAL NAME |
|---|---|---|---|
| 1. HT TMAPC | 73.1 | Hoescht | 1-trimethyl ammonium-2,3-dihardened tallowoyloxy propane chloride |
| 2. Hardened tallow fatty acid | 3.1 | Hoescht | Hardened tallow fatty acid |
| 3. IPA | 13.4 | Hoescht | (propanol-2) |
| 4. Genapol C-100 | 3.0 | Hoescht | Coco alcohol ethoxylated with 10 mols ethylene oxide |
| 5. Perfume | 3.6 | Quest | |
| 6. Microsil GP | 3.8 | Crosfield | Aluminosilicate |

Dry mixing-The solid HT TMAPC was placed in a high shear cutting vessel along with the nonionic surfactant and ground for 2–5 minutes. Perfume in an inorganic porous carrier was added to the mixture. This mixture was then sieved to the desired particle size or granulated.

In this example the HT TMAPC contained solvent (IPA) but the process works just as well in solvent-free systems.

Melt process-The above formulation was also prepared by a melt process. In this case the HT TMAPC, nonionic and perfume were melted to ensure intimate mixing of ingredients and allowed to cool and solidify. The solid premix and Microsil was then transferred to a high shear cutting vessel and ground to a powder as before.

It is also possible to add the perfume with the flow aid or other carrier instead of including it in the melt stage alternatively the perfume can be sprayed on.

Prilling-A molten mixture prepared as for the melt process was dropped 4 cm at a rate of about 65 g/min. onto a heated (150° C.) rotating (−2,000 rpm) disc. As the molten material was spun off the disc it was air cooled (as it radiates outward) and near-spherical granule particles (50–500 μm) were formed.

Powders made by all three methods exhibited good dispersion properties when used to prepare an aqueous dispersion. The aqueous dispersion dispersed well when further diluted in the rinse liquor of a front loading washing machine.

Example 2

A powder having the composition as in table 2 was prepared by the melt process, followed by grinding to a particle size of less than 350 μ. The solvents are present simply because they were contained in the cationic as supplied.

TABLE 2

| COMPOENT (% active as received) | WEIGHT % IN PRODUCT | SUPPLIER | CHEMICAL NAME |
|---|---|---|---|
| 1. HT TMAPC | 58.4 | Hoescht | 1-trimethyl ammonium-2,3-dihardened tallowoyloxy propane chloride |
| 2. Hardened tallow fatty acid* | 9.7 | Hoescht | Hardened tallow fatty acid |
| 3. Genapol C-100 (100%) | 2.8 | Hoescht | Coco alcohol with 10 mols ethoxylation |
| 4. Isopropanol* | 9.6 | Hoescht | 2-Propanol |
| 5. Glycerol* | 9.6 | Hoescht | 1,2,3-propane triol |
| 6. Perfume (LFU 384P) | 3.4 | Quest | |
| 7. Alusil | 6.5 | Crosfield | Aluminosilicate |

The Genapol C-100 nonionic is chosen for its biodegradability and for the viscosity control that it imparts to the predilute. The Alusil is included as a flow aid.

The powder was then used to make a 5% cationic predilute by shaking it for a dew seconds with 1 liter of warm water at 40° C. A good bit-free dispersion was obtained which remained stable for over one month and gave good softening when used as a liquid rinse conditioner.

It will be understood that although these examples describe the formation of predilutes having a cationic concentration of 5% by weight, the invention also encompasses other softening agents and higher concentrations of actives. For example, the powder could be dispersed to form a so-called concentrate for addition to the washing machine. Typical active levels in such a liquid concentrate would be 7–20% by weight.

Example 3

Example 3 was prepared using the melt process as described for Example 2 and used to prepare a 5% predilute in the same manner as demonstrated for Example 2.

The composition of Example 3 is shown in Table 3.

TABLE 3

| Component (% active as received) | Weight % in product | Supplier | Chemical Name |
|---|---|---|---|
| Tetranyl AHT-1 | 79.7 | Kao | N,N di(aryloxyethyl) N-hydroxy ethyl, N-methyl ammonium methy $SO_4$ |
| Genapol C-100 | 2.8 | Hoescht | 2-propanol |
| Perfume | 3.4 | Quest | |
| MSI/IPA* | 14.1 | Crosfield | Aluminosilicate |

*solvent supplied with Tetranyl AHT-1

Softening performance was evaluated by adding 0.1 g of softening active (2 ml of a 5% a.d. dispersion) to 1 liter of tap water, 10° FH., at ambient temperature containing 0.001% (w/w) sodium alkyl benzene sulphonate (ABS) in a tergotometer. The ABS was added to simulate carryover of anionic detergent from the main wash. Four pieces of terry towelling (20 cm×20 cm, 50 g total weight) were added to the tergotometer pot. The cloths were treated for 5 minutes at 60 rpm, spin dried to remove excess liquor and line dried overnight.

Softening of the fabrics was assessed by an expert panel of 4 people using a round robin paired comparison test protocol. Each panel member assessed four sets of test cloths. Each set of test cloths contained one cloth of each test system under a evaluation. Panel members were asked to pick the softer cloth of each pair during evaluation. A "no difference" vote was not permitted. Softness scores were calculated using an "Analysis of Variance" technique. Higher values are indicative of lower softening.

The results of Example 3 was compared with Example 2. The molar ratios of cationic active:nonionic are the same for the two formulations (95:5), the results are shown in table 4.

TABLE 4

| Example | Softening Score | Total Votes |
|---|---|---|
| 2 | 3.0 | 38 |
| 3 | 3.5 | 27 |

It can be seen that a composition containing Tetranyl AHT-1 has a softening effect not as great as with the composition comprising HT TMAPC.

Example 4

The conditioner powder of Example 4 was prepared with a composition as in table 5 using the melt process.

TABLE 5

| Component | % Weight |
|---|---|
| Adogen 100P | 86.1 |
| Genapol C-100 | 4.2 |
| Perfume | 4.3 |

TABLE 5-continued

| Component | % Weight |
|---|---|
| IPA* | 5.4 |

*IPA was used to form the melt, however it is likely that the level of IPA present in the final powder composition is minimal due to evaporation during the melt stage.

The powder exhibited good softening of fabrics when used in the same manner as Example 1.

Examples 5–14

Compositions were prepared using the melt process. In all cases the ratio of HTTMAPC:fatty acid is kept constant at 6:1 IPA was present in all formulations at a level of 0.4%. The ratios of H TTMAPC:nonionic are listed in table 6.

TABLE 6

| | Molar Ratio of HTTMAPC:Coco10EO | Weight Ratio of HTTMAPC:Coco10EO |
|---|---|---|
| Example 5 | 100:0 | 100.0 |
| Example 6 | 99:1 | 99.2:0.8 |
| Example 7 | 97.5:2.5 | 97.9:2.1 |
| Example 8 | 19:1 | 95.8:4.2 |
| Example 9 | 22:3 | 89.9:10.1 |
| Example 10 | 21:4 | 86.4:13.6 |
| Example 11 | 81.3:18.7 | 84:16 |
| Example 12 | 80.6:19.4 | 83.4:16.6 |
| Example 13 | 4:1 | 82.9:17.1 |
| Example 14 | 78.8:21.2 | 81.8:18.2 |

Examples 12, 13 and 14 could not be prepared as a powder as they were too sticky.

It can be seen that a molar ratio of HT TMAPC:Nonionic less than 80.6:19.4 he powder cannot be prepared.

The softening performance as described in Example 2 and 3 was tested in two set ties of experiments the results of which are demonstrated in tables 7 and 8.

TABLE 7

| Example | Softening Score |
|---|---|
| 8 | 5.5 |
| 7 | 6.25 |
| 6 | 5.5 |
| 5 | 6 |

TABLE 8

| Example | Softening Score |
|---|---|
| 7 | 5.25 |
| 8 | 5.75 |
| 9 | 3.5 |
| 10 | 3.0 |
| 11 | 3.25 |

It is demonstrated that the lower the cationic:nonionic surfactant molar ratio the more effective the softening properties of the composition.

Example 15

TABLE 9

| Component | Weight % in product | Supplier | Chemical Name |
|---|---|---|---|
| HT TMAPC* | 72.7 | Hoescht | 1-trimethyl ammonium-2,3 dihardened tallowoyloxy propane chloride |
| Fatty acid* | 3.1 | Hoescht | Hardened tallow fatty acid |
| IPA* | 13.8 | Hoescht | propan-2-ol |

TABLE 9-continued

| Component | Weight % in product | Supplier | Chemical Name |
|---|---|---|---|
| Genapol C100 | 3.0 | Hoescht | Coco alcohol ethoxylated with 10 mols ethylene oxide |
| Perfume | 3.6 | Quest | |
| Microsil | 3.8 | Crosfields | Aluminosilicate |

HT TMAPC*, fatty acid*, and IPA* were supplied as a continous solid by Hoescht.

The powder of Example 15 has the initial composition as shown in table 9. The powder was prepared using the dry mix process described in Example 1.

The powder was sieved to provide a particle between 150–250 μm.

The dispersability of Example 15 was tested in water at 7° C. and 20° C. using the following method:

Example 15 was weighed into a container. Demineralised (water 95 g at 20° C. or at 7° C.) is added to the powder and the container was sealed. The mixture was either shaken for 2 seconds or inverted once.

All of the resulting dispersions were filtered through the "Polymon 43T" 150 μm mesh (trademark ex George Hall Ltd). The mesh was dried in a oven at 105° C. for 2 hours, then weighed. The percentage of solid material retained by the mesh was calculated. The dispersion results of carrying out these tests are Shown in table 10.

TABLE 10

| | % of powder retained on 150 μm mesh | | | |
|---|---|---|---|---|
| | water at 7° C. | | water at 20° C. | |
| | 2 second shake | 1 inversion | 2 second shake | 1 inversion |
| 5 g powder/95 g water | 3.34 | 8.4 | 1.44 | 5 |
| 15 g powder/85 g water | 4.6 | 66 | 6.6 | 73 |

Table 10 demonstrates that with 5 g of powder the powder disperses rapidly with minimum agitation at 7° C. and 20° C. When 15 g of powder is used it can be seen that greater agitation is needed.

The powder of Example 15 has been tested for softening using the procedure described for Example 3. The results are given in table 11

TABLE 11

| | water at 7° C. prediluted (1×) | water at 20° C. prediluted (1×) |
|---|---|---|
| Softening Score | 4.00 | 3.00 |

Water would be expected to give a softening score of 8.

TABLE 12

| Component | Supplier | Weight % in Product | | | | |
|---|---|---|---|---|---|---|
| | | Example 16 | Example 17 | Example 18 | Example 19 | Example 20 |
| HT TMAPC* | Hoescht | 73.2 | 71.2 | 73.6 | 73.5 | 72.7 |
| Fatty acid* | Hoescht | 3.0 | 3.0 | 3.0 | 3.0 | 3.0 |
| IPA* | Hoescht | 13.4 | 13.2 | 13.6 | 13.6 | 13.4 |
| Perfume | Quest | 3.6 | 3.6 | 3.7 | 3.7 | 3.6 |
| Microsil | Crosfields | 3.8 | 3.8 | 3.9 | 3.9 | 3.8 |
| Genapol C100[1] | Hoescht | 3.0 | — | — | — | — |
| Genapol C200[2] | Hoescht | — | 5.2 | — | — | — |
| Genapol T150[3] | Hoescht | — | — | 2.2 | — | — |
| Dobanol 25-5 nonionic $C_{12}$–$C_{15}$ alcohol ethoxylated with 5 mols ethylene oxide | Shell | — | — | — | 2.3 | — |
| Arosurf 66-10 Isostearethalcohol 10 mols ethylene oxide | Sherex | — | — | — | — | 3.5 |

HT TMAPC* and IPA* supplied as continuous solid.
[1] = (coco alcohol ethoxylated with 10 mols ethylene oxide)
[2] = (coco alcohol ethoxylated with 20 mols ethylene oxide)
[3] = (coco alcohol ethoxylated with 15 mols ethylene oxide)

The powders of Examples 16–20 have the compositions as shown in Table 12. The powders were prepared using the dry mix process described in Example 1.

The powders were tested for softening using the process described for Example 3. The results are given in table 13.

TABLE 13

| Example | Softening Score |
|---|---|
| 16 | 3.50 |
| 17 | 3.25 |
| 18 | 3.75 |
| 19 | 4.50 |
| 20 | 4.75 |

It is thus demonstrated that softening occurs with a range of nonionic actives.

We claim:

1. A rinse conditioner powder comprising (a) 40–95% of a quaternary ammonium softening compound selected from a compound of formula

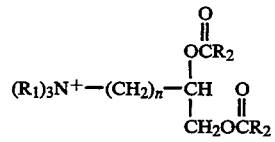

wherein each $R_1$ is independently selected from $C_{1-4}$ alkyl, hydroxyalkyl or $C_2$–$C_4$, hydroxy alkenyl; and wherein each $R_2$ is independently selected from $C_{7-27}$ alkyl or alkenyl groups, and n is an integer from 0 to 5, together with about 2 to about 16% by weight of a nonionic dispersion aid comprising a linear long-chain alcohol ethoxylate having more than 5 moles of ethoxylation such that the powder forms a dispersion having 5–20% by weight of the quaternary ammonium softening compound when mixed with water outside the washing machine for use in a washing procedure during a time taken to complete the washing procedure.

2. A powder according to claim 1 having an average particle diameter of less than 1000 microns.

3. A powder according to claim 2 wherein the average particle diameter is 150–350 microns.

4. A process according to claim 3 wherein the molar ratio of the quaternary ammonium softening compound to the nonionic dispersion aid is about 97.5:2.5 to 81.

5. A process according to claim 3 wherein the quaternary ammonium softening compound is 1-trimethyl ammonium-2,3 dihardened tallowoyloxy propane chloride.

6. A process according to claim 3 wherein the powder further comprises up to 20% of a fatty acid.

7. A process according to claim 6 wherein the molar ratio of the quaternary ammonium softening compound to the fatty acid is greater than 6:1.

8. A process to form an aqueous dispersion of a rinse conditioner consisting essentially of the steps of:

(a) preparing a rinse conditioner powder containing 40 to 95 wt. % of a quaternary ammonium softening compound having a formula

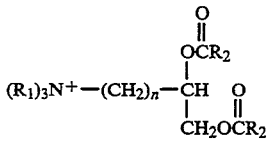

wherein each $R_1$ is independently selected from $C_{1-4}$ alkyl, hydroxyalkyl or $C_2$–$C_4$ hydroxy alkenyl; and wherein each $R_2$ is independently selected from $C_{7-27}$ alkyl or alkenyl groups, and n is an integer from 0 to 5, together with about 2 to about 16% by weight of a nonionic dispersion aid comprising a linear long-chain alcohol ethoxylate having mere than 5 moles of ethoxylation; and (b) mixing the powder with Water having a temperature of 7° C. to 20° C. and shaking for up to 5 seconds to form a dispersion having 5–20% of the quaternary ammonium softening compound, the dispersion formed outside the washing machine for use in a washing procedure during a time take n to complete the washing procedure.

* * * * *